US007643996B1

(12) United States Patent
Gottesman

(10) Patent No.: US 7,643,996 B1
(45) Date of Patent: Jan. 5, 2010

(54) ENHANCED WAVEFORM INTERPOLATIVE CODER

(75) Inventor: Oded Gottesman, Goleta, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/831,843

(22) PCT Filed: Dec. 1, 1999

(86) PCT No.: PCT/US99/28449

§ 371 (c)(1),
(2), (4) Date: Aug. 13, 2001

(87) PCT Pub. No.: WO00/33297

PCT Pub. Date: Jun. 8, 2000

Related U.S. Application Data

(60) Provisional application No. 60/110,522, filed on Dec. 1, 1998, provisional application No. 60/110,641, filed on Dec. 1, 1998.

(51) Int. Cl.
*G10L 13/04* (2006.01)

(52) U.S. Cl. ..... 704/265; 704/219; 704/230; 704/220; 704/205; 704/223

(58) Field of Classification Search ..... 704/205, 704/207, 219, 230, 220, 222, 225, 265, 223
See application file for complete search history.

(56) References Cited

U.S. PATENT DOCUMENTS

| | | | | |
|---|---|---|---|---|
| 4,653,098 | A * | 3/1987 | Nakata et al. | 704/207 |
| 5,086,471 | A * | 2/1992 | Tanaka et al. | 704/222 |
| 5,517,595 | A * | 5/1996 | Kleijn | 704/205 |
| 6,418,408 | B1 * | 7/2002 | Udaya Bhaskar et al. | 704/219 |
| 6,493,664 | B1 * | 12/2002 | Udaya Bhaskar et al. | 704/222 |

* cited by examiner

*Primary Examiner*—Vijay B Chawan
(74) *Attorney, Agent, or Firm*—Berliner & Associates

(57) ABSTRACT

An Enhanced analysis-by-synthesis Waveform Interpolative speech coder able to operate at 4 kbps. Novel features include analysis-by-synthesis quantization of the slowly evolving waveform, analysis-by-synthesis vector quantization of the dispersion phase, a special pitch search for transitions, and switched-predictive analysis-by-synthesis gain vector quantization. Subjective quality tests indicate that it exceeds MPEG-4 at 4 kbps and of G.723.1 at 6.3 kbps.

34 Claims, 4 Drawing Sheets

ENHANCED WAVEFORM INTERPOLATIVE CODER

CROSS REFERENCE TO RELATED APPLICATIONS

This application claims the benefit of Provisional Patent Application Nos. 60/110,522, filed Dec. 1, 1998 and 60/110,641 filed Dec. 1, 1998.

BACKGROUND OF THE INVENTION

Recently, there has been growing interest in developing toll-quality speech coders at rates of 4 kbps and below. The speech quality produced by waveform coders such as code-excited linear prediction (CELP) coders degrades rapidly at rates below 5 kbps [B. S. Atal, and M. R. Schroder, "Stochastic Coding of Speech at Very Low Bit Rate", Proc. Int. Conf. Comm, Amsterdam, pp. 1610-1613, 1984]. On the other hand, parametric coders such as the waveform-interpolative (WI) coder, the sinusoidal-transform coder (STC), and the multiband-excitation (MBE) coder produce good quality at low rates, but they do not achieve toll quality [Y. Shoham, "High Quality Speech Coding at 2.4 and 4.0 kbps Based on Time Frequency-Interpolation", IEEE ICASSP'93, Vol. II, pp. 167-170, 1993; W. B. Kleijn, and J. Haagen, "Waveform Interpolation for Coding and Synthesis", in Speech Coding Synthesis by W. B. Kleijn and K. K. Paliwal, Elsevier Science B. V., Chapter 5, pp. 175-207, 1995; I. S. Burnett, and D. H. Pham, "Multi-Prototye Waveform Coding using Frame-by-Frame Analysis-by-Synthesis", IEEE ICASSP'97, pp. 1567-1570, 1997; R. J. McAulay, and T. F. Quatieri, "Sinusoidal Coding", in Speech Coding Synthesis by W. B. Kleijn and K. K. Paliwal, Elsevier Science B. V., Chapter 4, pp. 121-173, 1995; and D. Griffin, and J. S. Lim, "Multiband Excitation Vocoder", IEEE Trans. ASSP, Vol. 36, No. 8, pp. 1223-1235, August 1988]. This is mainly due to lack of robustness to parameter estimation, which is commonly done in open loop, and to inadequate modeling of non-stationary speech segments. Also, in parametric coders the phase information is commonly not transmitted, and this is for two reasons: first, the phase is of secondary perceptual significance; and second, no efficient phase quantization scheme is known. WI coders typically use a fixed phase vector for the slowly evolving waveform [Shoham, supra; Kleijn et al, supra; and Burnett et al, supra]. For example, in Kleijn et al, a fixed male speaker extracted phase was used. On the other hand, waveform coders such as CELP, by directly quantizing the waveform, implicitly allocate an excessive number of bits to the phase information—more than is perceptually required.

SUMMARY OF THE INVENTION

The present invention overcomes the foregoing drawbacks by implementing a paradigm that incorporates analysis-by-synthesis (AbS) for parameter estimation, and a novel pitch search technique that is well suited for the non-stationary segments. In one embodiment, the invention provides a novel, efficient AbS vector quantization (VQ) encoding of the dispersion phase of the excitation signal to enhance the performance of the waveform interpolative (WI) coder at a very low bit-rate, which can be used for parametric coders as well as for waveform coders. The enhanced analysis-by-synthesis waveform interpolative (EWI) coder of this invention employs this scheme, which incorporates perceptual weighting and does not require any phase unwrapping.

The WI coders use non-ideal low-pass filters for downsampling and unsampling of the slowly evolving waveform (SEW). In another embodiment of the invention, A novel AbS SEW quantization scheme is provided, which takes the non-ideal filters into consideration. An improved match between reconstructed and original SEW is obtained, most notably in the transitions.

Pitch accuracy is crucial for high quality reproduced speech in WI coders. Still another embodiment of the invention provides a novel pitch search technique based on varying segment boundaries; it allows for locking onto the most probable pitch period during transitions or other segments with rapidly varying pitch.

Commonly in speech coding, the gain sequence is downsampled and interpolated. As a result it is often smeared during plosives and onsets. To alleviate this problem, a further embodiment of the invention provides a novel switched-predictive AbS gain VQ scheme based on temporal weighting.

More particularly, the invention provides a method for interpolative coding of input signals at low data rates in which there may be significant pitch transitivity, the signals having an evolving waveform, the method incorporating at least one, and preferably all, of the following steps:

(a) AbS VQ of the SEQ whereby to reduce distortion in the signal by obtaining the accumulated weighted distortion between an original sequence of waveforms and a sequence of quantized and interpolated waveforms;

(b) AbS quantization of the dispersion phase;

(c) locking onto the most probable pitch period of the signal using both a spectral domain pitch search and a temporal domain pitch search;

(d) incorporating temporal weighting in the AbS VQ of the signal gain, whereby to emphasize local high energy events in the input signal;

(e) applying both high correlation and low correlation synthesis filters to a vector quantizer codebook in the AbS VQ of the signal gain whereby to add self correlation to the codebook vectors and maximize similarity between the signal waveform and a codebook waveform;

(f) using each value of gain in the AbS VQ of the signal gain to obtain a plurality of shapes, each composed of a predetermined number of values, and comparing said shapes to a vector quantized codebook of shapes, each having said predetermined number of values, e.g., in the range of 2-50, preferably 5-20; and (g) using a coder in which a plurality of bits, e.g. 4 bits, are allocated to the SEW dispersion phase.

The method of the invention can be used in general with any waveform signal, and is particularly useful with speech signals. In the step of AbS VQ of the SEW, distortion is reduced in the signal by obtaining the accumulated weighted distortion between an original sequence of waveforms and a sequence of quantized and interpolated waveforms. In the step of AbS quantization of the dispersion phase, at least one codebook is provided that contains magnitude and phase information for predetermined waveforms. The linear phase of the input is crudely aligned, then iteratively shifted and compared to a plurality of waveforms reconstructed from the magnitude and phase information contained in one or more codebooks. The reconstructed waveform that best matches one of the iteratively shifted inputs is selected.

In the step of locking onto the most probable pitch period of the signal, the invention includes searching the temporal domain pitch, defining a boundary for a segment of said temporal domain pitch, maximizing the length of the boundary by iteratively shrinking and expanding the segment, and maximizing the similarity by shifting the segment. The searches are preferably conducted respectively at 100 Hz and 500 Hz.

DETAILED DESCRIPTION OF THE INVENTION

The invention has a number of embodiments, some of which can be used independently of the others to enhance speech and other signal coding systems. The embodiments cooperate to produce a superior coding system, involving AbS SEW optimization, and novel dispersion phase quantizer, pitch search scheme, switched-predictive AbS gain VQ, and bit allocation.

AbS SEW Quantization

Figure 1:
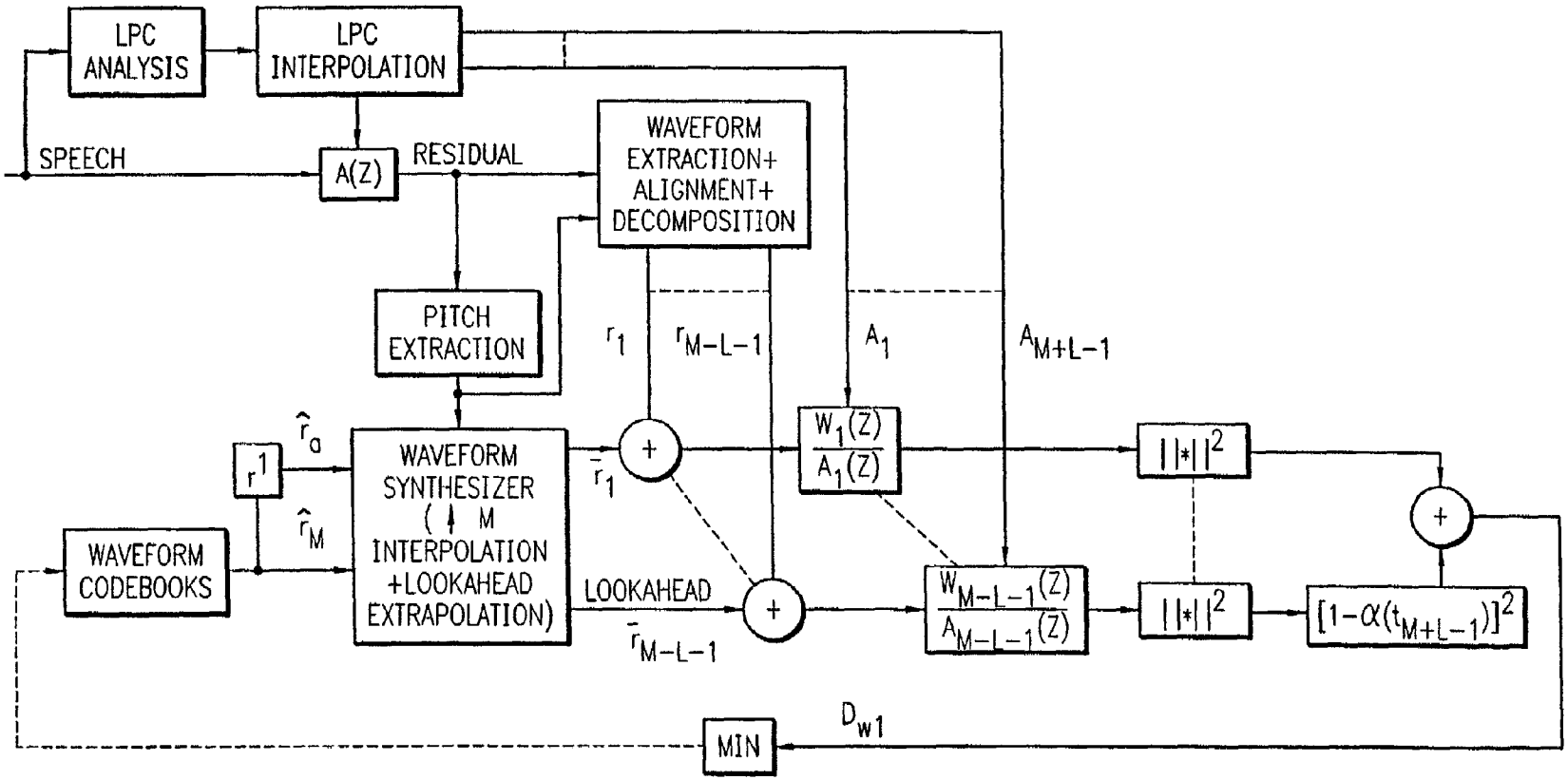
FIG. 1 is a block diagram of the AbS SEW vector quantization.

Commonly in WI coders the SEW is distorted by downsampling and upsampling with non-ideal low-pass filters. In order to reduce such distortion, an AbS SEW quantization scheme, illustrated in FIG. 1, was used. Consider the accumulated weighted distortion, $D_{wl}$, between the input SEW vectors, $r_m$, and the interpolated vectors, $\hat{r}_m$, given by:

$$D_{wl}(\hat{r}_M, \{r_m\}_{m=1}^{M+L-1}) = \left[ \begin{array}{l} \sum_{m=1}^{M} [r_m - \tilde{r}_m]^H w_m [r_m - \tilde{r}_m] + \\ \sum_{m=M+1}^{M+L-1} [1-\alpha(t_m)]^2 [r_m - \tilde{r}_M]^H w_m [r_m - \tilde{r}_M] \end{array} \right] \quad (1)$$

where the first sum is that of many current distortions and the second sum is that of lookahead distortions. H denotes Hermitian (transposed+complex conjugate), M is the number of waveforms per frame, L is the lookahead number of waveforms, $\alpha(t)$ is some increasing interpolation function in the range $0 \leqq \alpha(t) \leqq 1$, and $W_m$ is diagonal matrix whose elements, $w_{kk}$, and the combined spectral-weighting and synthesis of the k-th harmonic given by:

$$w_{kk} = \frac{1}{K}\left|\frac{gA(z/\gamma_1)}{\hat{A}(z)A(z/\gamma_2)}\right|^2 z = e^{j\left(\frac{2\pi}{P}\right)k};\ k = 1, \ldots, K \quad (2)$$

where P is the pitch period, K is the number of harmonics, g is the gain, A(z) and $\hat{A}(z)$ are the input and the quantized LPC polynomials respectively, and the spectral weighting parameters satisfy $0 \leqq \gamma_2 < \gamma_2 \leqq 1$. It is also possible to leave out the inverse of the number of harmonics, i.e., the 1/K parameter, the gain, i.e. the g parameter, or another combination of input and quantized LPC polynomials, i.e. the A(Z) and $\hat{A}(Z)$ parameters.

The interpolated SEW vectors are given by:

$$\hat{r}_m = [1-\alpha(t_m)]\hat{r}_0 + \alpha(t_m)\hat{r}_M;\ m = 1, \ldots M \quad (3)$$

where t is time, m is the number of waveforms in a frame, and $\hat{r}_0$ and $\hat{r}_M$ are the quantized SEW at the previous and at the current frame respectively. The parameter $\alpha$ is an increasing linear function from 0 to 1. It can be shown that the accumulated distortion in equation (1) is equal to the sum of modeling distortion and quantization distortion:

$$D_{wl}(\hat{r}_M, \{r_m\}_{m=1}^{M+L-1}) = D_{wl}(r_{M,opt}, \{r_m\}_{m=1}^{M+L-1}) + D_w(\hat{r}_M, r_{M,opt}) \quad (4)$$

where the quantization distortion is given by:

$$D_w(\hat{r}_M, r_{M,opt}) = (\hat{r}_M - r_{M,opt})^H W_{M,opt}(\hat{r}_M - r_{M,opt}) \quad (5)$$

The optimal vector, $r_{M,opt}$, which minimizes the modeling distortion, is given by:

$$r_{M,opt} = w_{M,opt}^{-1}\left[\sum_{m=1}^{M} \alpha(t_m) w_m [r_m - [1-\alpha(t_m)]\hat{r}_0] + \sum_{m=M+1}^{M+L-1} [1-\alpha(t_m)]^2 W_m r_m\right] \quad (6)$$

where, $$w_{M,opt} = \sum_{m=1}^{M} \alpha(t_m)^2 w_m + \sum_{m=M+1}^{M+L-1} [1-\alpha(t_m)]^2 w_m \quad (7)$$

Therefore, VQ with the accumulated distortion of equation (1) can be simplified by using the distortion of equation (5), and:

$$\hat{r}_M = \underset{r_i'}{\operatorname{argmin}}\{(r_i' - r_{M,opt})^H w_{M,opt}(r_i' - r_{M,opt})\} \quad (6)$$

Figure 2:
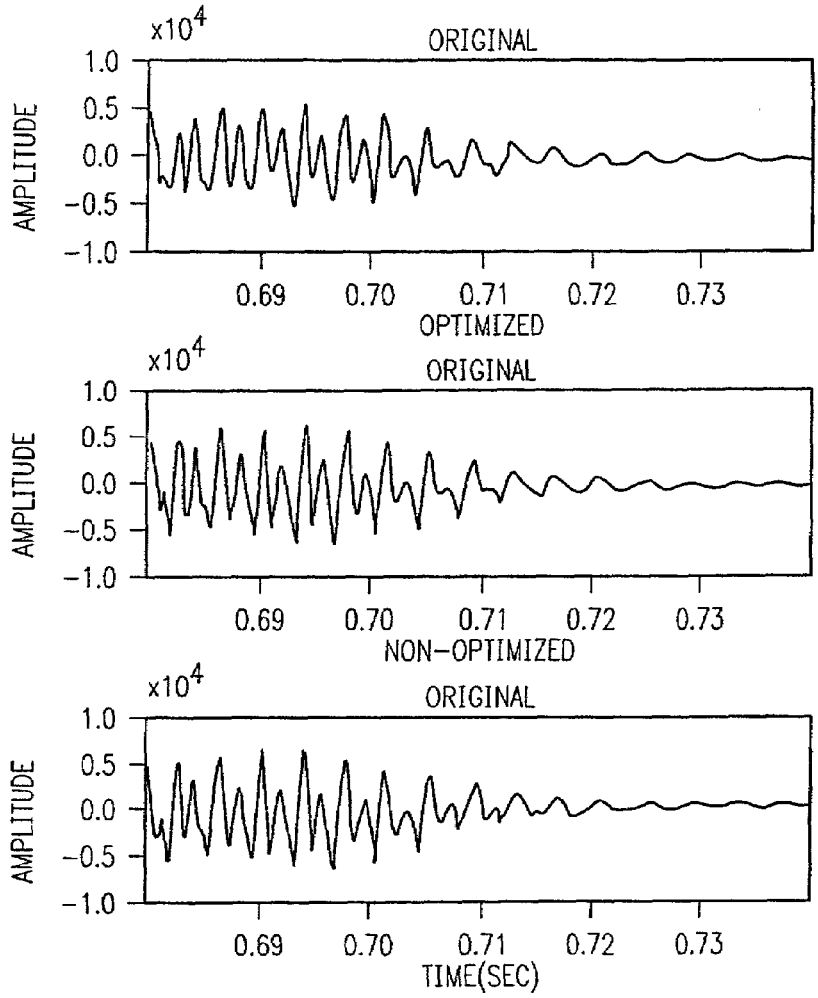
FIG. 2 shows amplitude-time plots illustrating the improved waveform matching obtained for a non-stationary speech segment by interpolating the optimized SEW.

An improved match between reconstructed and original SEW is obtained, most notably in the translations. FIG. 2 illustrates the improved waveform matching obtained for a non-stationary speech segment by interpolating the optimized SEW.

AbS Phase Quantization

Figure 3:
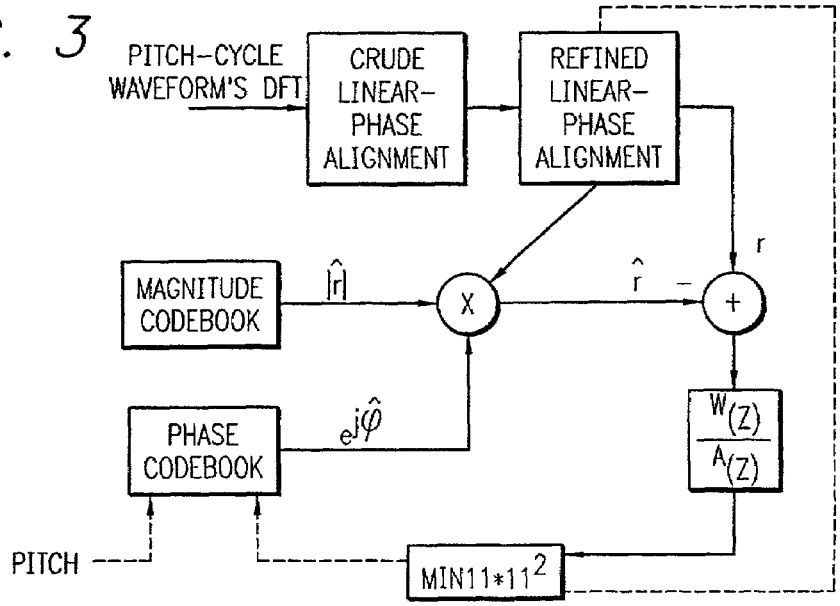
FIG. 3 is a block diagram of the AbS dispersion phase vector quantization.

The dispersion-phase vector quantization scheme is illustrated in FIG. 3. Consider a pitch cycle which is extracted from the residual signal, and is cyclically shifted such that its pulse is located at position zero. Let its discrete Fourier transform (DFT) are denoted by r; the resulting DFT phase is the dispersion phase, $\phi$, which determines, along with the magnitude $|r|$, the waveform's pulse shape. The SEW waveform r is the vector of complex DFT coefficients. The complex number can represent magnitude and phase. After quantization, the components of the quantized magnitude vector, $|\hat{r}|$, are multiplied by the exponential of the quantized phases, $\hat{\phi}(k)$, to yield the quantized waveform DFT, $\hat{r}$, which is subtracted from the input DFT to produce the error DFT. The error DFT is then transformed to the perceptual domain by weighting it by the combined synthesis and weighting filter W(z)/A(z). In a crude linear phase alignment, the encoder searches for the phase that minimizes the energy of the perceptual domain error, shifting the signal such that the peak is located at time zero. It then allows a refining cyclic shift of the input waveform during the search, incrementally increasing or decreasing the linear phase, to eliminate any residual phase shift between the input waveform and the quantized waveform. Although shown in FIG. 3 as occurring immediately after the crude linear phase alignment, the refined linear phase alignment step can occur elsewhere in the cycle, e.g., between the X and + steps. Phase dispersion quantization aims to improve waveform matching. Efficient quantization can be obtained by using the perceptually weighted distortion:

$$D_w(r,\hat{r})=(r-\hat{r})^H W(r-\hat{r}) \tag{7}$$

The magnitude is perceptually more significant than the phase; and should therefore be quantized first. Furthermore, if the phase were quantized first, the very limited bit allocation available for the phase would lead to an excessively degraded spectral matching of the magnitude in favor of a somewhat improved, but less important, matching of the waveform. For the above distortion, the quantized phase vector is given by:

$$\hat{\varphi} = \underset{\hat{\varphi}_i}{\operatorname{argmin}}\left\{\left(r - e^{j\hat{\varphi}_i}|\hat{r}|\right)^H w\left(r - e^{j\hat{\varphi}_i}|\hat{r}|\right)\right\} \tag{8}$$

where i is the running phase codebook index, and $e^{j\hat{\phi}_i}$ is the respective diagonal phase exponent matrix where i is the running phase codebook index, and the respective phase exponent matrix is given by $$e^{\hat{\varphi}_{ji}} = \operatorname{diagonal}\left\{e^{j\hat{\varphi}_i(k)}\right\}. \tag{9}$$

The AbS search for phase quantization is based on evaluating (8) for each candidate phase codevector. Since only trigonometric functions of the phase candidates are used, phase unwrapping is avoided. The EWI coder uses the optimized SEW, $r_{M,opt}$, and the optimized weighting, $w_{M,opt}$, for the AbS phase quantization.

$$\text{Equation (8)} = \underset{\hat{\varphi}_i}{\operatorname{argmax}}\left\{\int_0^{2\pi} r_w(\phi)\hat{r}_w(\hat{\varphi}_i, \phi)\, d\phi\right\}$$

Equivalently, the quantized phase vector can be simplified to:

$$\hat{\varphi} = \underset{\hat{\varphi}_i}{\operatorname{argmax}}\left\{\sum_{k=1}^{K} w_{kk}|r(k)||\hat{r}(k)|\cos(\varphi(k) - \hat{\varphi}(k)_i)\right\} \tag{10}$$

where $\hat{\phi}(k)$ is the phase of, r(k), the k-th input DFT coefficient. The average global distortion measure for M vector set is:

$$D_{w,Global} = \frac{1}{M}\sum_{m=\{Data\ Vectors\}} D_w\left(r_m, e^{j\hat{\varphi}_m}|\hat{r}|_m\right) = \tag{11}$$

-continued $$\frac{1}{M}\sum_{m=\{Data\ Vectors\}} \frac{1}{K_m}\sum_{k=1}^{K_m} w_{kk,m}\left|r(k)_m - e^{j\hat{\varphi}(k)_m}|\hat{r}(k)|_m\right|^2$$

The centroid equation [A. Gersho et al, "Vector Quantization and Signal Compression", Kluwer Academic Publishers, 1992] of the k-th harmonic's phase for the j-th cluster, which minimizes the global distortion in equation (11), is given by:

$$\hat{\varphi}(k)_{j^{th}\text{-}cluster} = \operatorname{atan}\left[\frac{\sum_{m=\{j^{th}\text{-}cluster\}} \frac{1}{K_m} w_{kk,m}|\hat{r}(k)_m||r(k)_m|\sin(\varphi(k)_m)}{\sum_{m=\{j^{th}\text{-}cluster\}} \frac{1}{K_m} w_{kk,m}|\hat{r}(k)_m||r(k)_m|\cos(\varphi(k)_m)}\right]$$

These centroid equations use trigonometric functions of the phase, and therefore do not require any phase unwrapping. It is possible to use $|r(k)_m|^2$ instead of $|\hat{r}(k)_m||r(k)_m|$.

The phase vector's dimension depends on the pitch period and, therefore, a variable dimension Q has been implemented. In the WI system the possible pitch period value was divided into eight ranges, and for each range of pitch period an optimal codebook was designed such that vectors of dimension smaller than the largest pitch period in each range are zero padded.

Pitch changes over time cause the quantizer to switch among the pitch-range codebooks. In order to achieve smooth phase variations whenever such switch occurs, overlapped training clusters were used.

The phase-quantization scheme has bene implemented as a part of WI coder, and used to quantize the SEW phase. The objective performance of the suggested phase VQ has been tested under the following conditions:

Phase Bits: 0-6 ever 20 ms, a bitrate of 0-300 bit/second.

8 pitch ranges were selected, and training has been performed for each range.

Modified IRS (MIRS) filtered speech (Female+Male)

Training Set: 99,323 vectors.

Test Score: 83,099 vectors.

Non-MIRS filtered speech (Female+Male)

Training Set: 101,359 vectors.

Test Set: 95,446 vectors.

The magnitude was not quantized.

Figure 4:
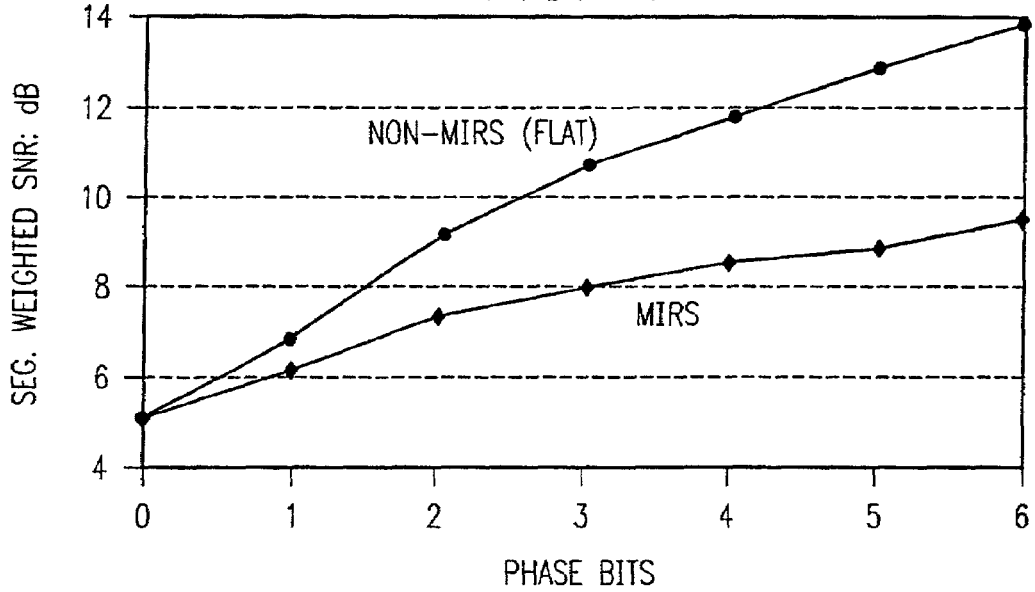
FIG. 4 is a plot of the segmentally weighted signal-to-noise ratio of the phase vector quantization versus the number of bits, for modified intermediate reference system (MIRS) and for non-MIRS (flat) speech.

The segmental weighted signal-to-noise ratio (SNR) of the quantizer is illustrated in FIG. 4. The proposed system achieves approximately 14 dB SNR for as low as 6 bits for non-MIRS filtered speech, and nearly 10 dB for MIRS filtered speech.

Figure 5:
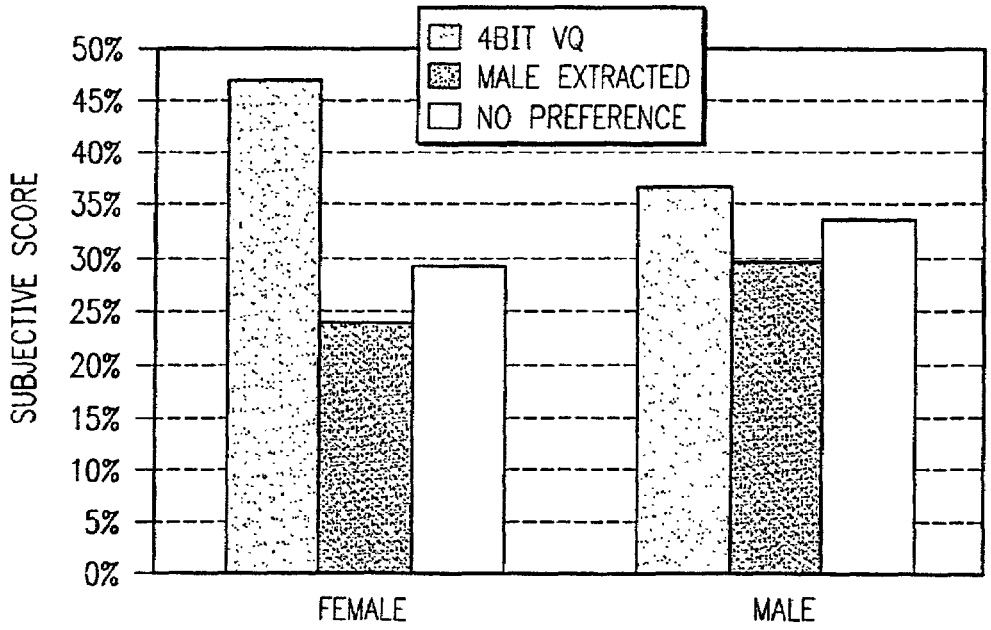
FIG. 5 shows the results of subjective A/B tests comparing a 4-bit phase vector quantization and a male extracted fixed phase.

Recent WI coders have used a male speaker extracted dispersion phase [Kleijn et al, supra: Y. Shoham, "Very Low Complexity Interpolative Speech Coding at 1.2 to 2.4 KBPS", IEEE ICASSP '97, pp. 1599-1602, 1997]. A subjective A/B testw as conducted to compare the dispersion phase of this invention, using only 4 bits, to a male extracted dispersion phase. The test data included 16 MIRS speech sentences, 8 of which are of female speakers, and 8 of male speakers. During the test, all pairs of file were played twice in alternating order, and the listeners could vote for either of the systems, or for no preference. The speech material was synthesized using WI system in which only the dispersion phase was quantized every 20 ms. Twenty one listeners participated in the test. The test results, illustrated in FIG. 5, show improvement in speech quality by using the 4-bit phase VQ. The improvement is larger for female speakers than for male. This may be explained by a higher number of bits per vector sample for female, by less spectral masking for female's speech, and by a larger amount of phase-dispersion variation for female. The codebook design for the dispersion-phase quantization involves a tradeoff between robustness in terms of smooth phase variations and waveform matching. Locally optimized codebook for each pitch value may improve the waveform matching on the average, but may occasionally yield abrupt and excessive changes which may cause temporal artifacts.

Pitch Search

Figure 6:
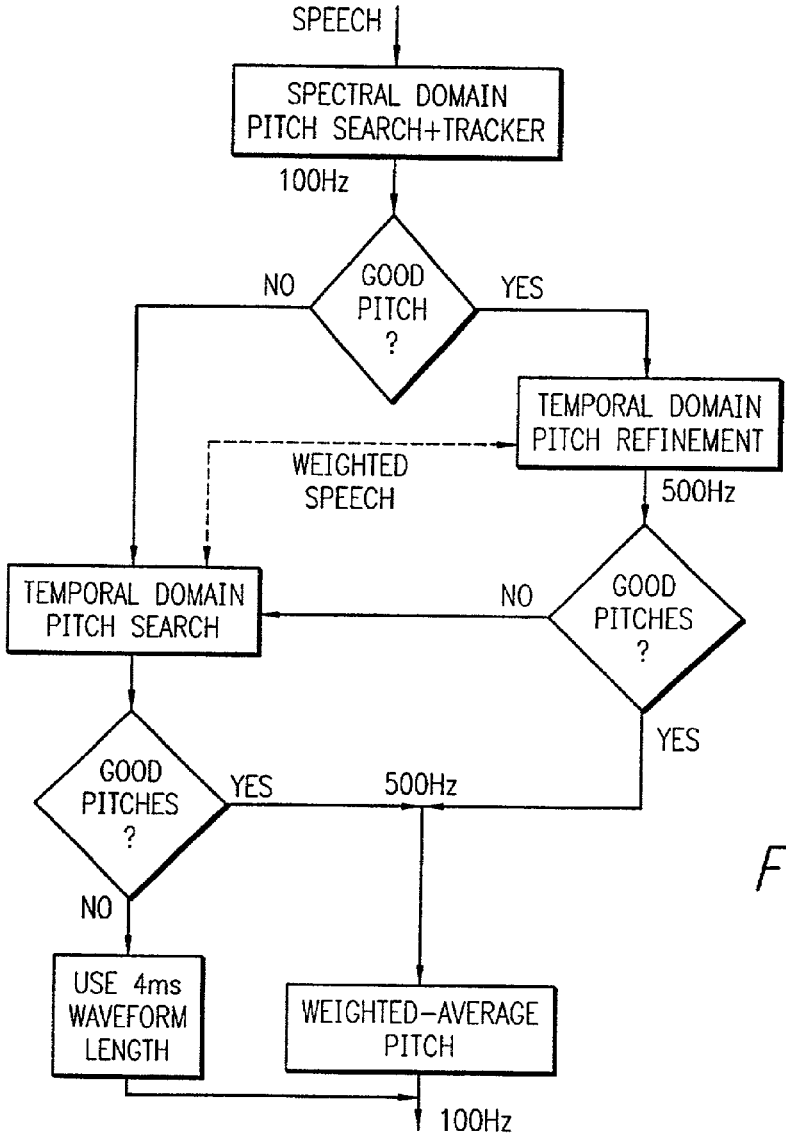
FIG. 6 is a block diagram of the pitch search of the EWI coder.

The pitch search of the EWI coder consists of a spectral domain search employed at 100 Hz and a temporal domain search employed at 500 Hz, as illustrated in FIG. 6. The spectral domain pitch search is based on haromonic matching [McAuley et al, supra; Griffin et al, supra; and E. Shiomot, V. Cuperman, and A. Gersho, "Hybrid Coding of Speech at 4 kbps", IEEE Speech Coding Workshop, pp. 37-38, 1997]. The temporal domain pitch search is based on varying segment boundaries. It allows for locking onto the most probable pitch period even during transitions or other segments with rapidly varying pitch (e.g., speech onset or offset or fast changing periodicity). Initially, pitch periods, $P(n_i)$, are searched every 2 ms at instances $n_i$ by maximizing the normalized correlation of the weighted speech $s_w(n)$, that is:

$$P(n_i) = \underset{\tau, N_1, N_2}{\operatorname{argmax}}\{\rho(n_i, \tau, N_1, N_2)\} = \underset{\tau, N_1, N_2}{\operatorname{argmax}}\left\{\frac{\sum_{n=n_i-N_1\Delta}^{n_i+\tau+N_2\Delta} s_w(n)s_w(n-\tau)}{\sqrt{\sum_{n=n_i-N_1\Delta}^{n_i+\tau+N_2\Delta} s_w(n)s_w(n)}\sqrt{\sum_{n=n_i-N_1\Delta}^{n_i+\tau+N_2\Delta} s_w(n-\tau)s_w(n-\tau)}}\right\} \quad (12)$$

where $\tau$ is the shift in the segment, $\Delta$ is some incremental segment used in the summations for computational simplicity, and $0 \leqq N_j \leqq \lfloor 160/\Delta \rfloor$. Then, every 10 ms a weighted-mean pitch value is calculated by:

$$P_{mean} = \sum_{i=1}^{5} \rho(n_i)P(n_i) \Big/ \sum_{i=1}^{5} \rho(n_i) \quad (13)$$

where $p(n_i)$ is the normalized correlation for $P(n_i)$. The above values (160, 10, 5) are for the particular coder and is used for illustration. Equation (12) describes the temporal domain pitch search and the temporal domain pitch refinement blocks of FIG. 6. Equation (13) describes the weighted average pitch block of FIG. 6.

Gain Quantization

Figure 7:
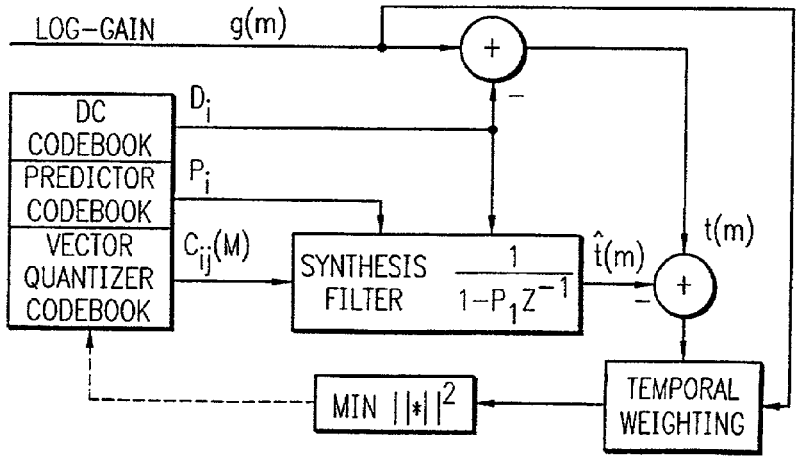
FIG. 7 is a block diagram of the switch-predictive AbS gain VQ using temporal weighting.

The gain trajectory is commonly smeared during plosives and onsets by downsampling and interpolation. This problem is addressed and speech crispness is improved in accordance with an embodiment of the invention that provides a novel switched-predictive AbS gain VQ technique, illustrated in FIG. 7. Switched-prediction is introduced to allow for different levels of gain correlation, and to reduce the occurrence of gain outliers. In order to improve speech crispness, especially for plosives and onsets, temporal weighting is incorporated in the AbS gain VQ. The weighting is a monotonic function of the temporal gain. Two codebooks of 32 vectors each are used. Each codebook has an associated predictor coefficient, $P_i$, and a DC offset $D_i$. The quantization target vector is the DC removed log-gain vector denoted by t(m). The search for the minimal weighted mean squared error (WMSE) is performed over all the vectors, $c_{ij}(m)$, of the codebooks. The quantized target, $\hat{i}(m)$, is obtained by passing the quantized vector, $c_{ij}(m)$, through the synthesis filter. Since each quantized target vector may have a different value of the removed DC, the quantized DC is added temporarily to the filter memory after the state update, and the next quantized vector's DC is subtracted from its before filtering is performed. Since the predictor coefficients are known, direct VQ can be used to simplify the computations. The synthesis filter adds self correlation to the codebook vector. All combinations are tried and whether high or low self correlation is used depends on which yields the best results.

Bit Allocation

The bit allocation of the coder is given in Table 1. The frame length is 20 ms, and ten waveforms are extracted per frame. The pitch and the gain are coded twice per frame.

TABLE 1

Bit allocation for EWI coder

| Parameter | Bits/Frame | Bits/second |
|---|---|---|
| LPC | 18 | 900 |
| Pitch | 2 × 6 = 12 | 600 |
| Gain | 2 × 6 = 12 | 600 |
| REW | 20 | 1000 |
| SEW magn. | 14 | 700 |
| SEW phase | 4 | 200 |
| Total | 80 | 4000 |

Subjective Results

A subjective A/B test was conducted to compare the 4 kbps EWI coder of this invention to MPEG-4 at 4 kbps, and to G.723.1. The test data included 24 MIRS speech sentences, 12 of which are of female speakers, and 12 of male speakers. Fourteen listeners participated in the test. The test results, listed in Tables 2 to 4, indicate that the subjective quality of EWI exceeds that of MPEG-4 at 4 kbps an of G.723.1 at 5.3 kbps, and it is slightly better than that of G.723.1 at 6.3 kbps.

TABLE 2

| Test | 4 kbps WI | 4 kbps MPEG-4 |
|---|---|---|
| Female | 65.48% | 34.52% |
| Male | 61.90% | 38.10% |
| Total | 63.69% | 36.31% |

Table 2 shows the results of subjective A/B tests for comparison between the 4 kbps WI coder and th 4 kbps MPEG-4. Within 95% certainty the WI preference lies in [58.63%, 68.75%].

TABLE 3

| Test | 4 kbps WI | 5.3 kbps G.723.1 |
|---|---|---|
| Female | 57.74% | 42.26% |
| Male | 61.31% | 38.69% |
| Total | 59.52% | 40.48% |

Table 3 shows the results of subjective A/B tests for comparison between the 4 kbps WI coder to 5.3 kbps G.723.1. With 95% certainty the WI preference lies in [54.17%, 64.88%].

TABLE 4

| Test | 4 kbps WI | 6.3 kbps G.723.1 |
|---|---|---|
| Female | 54.76% | 45.24% |
| Male | 52.98% | 47.02% |
| Total | 53.87% | 46.13% |

Table 4. Results of subjective A/B test for comparison between the 4 kbps WI coder to 6.3 kbps G.723.1. With 95% certainty the WI preference lies in [48.51%, 59.23%].

The present invention incorporates several new techniques that enhance the performance of the WI coder, analysis-by-synthesis vector-quantization of the dispersion-phase, AbS optimization of the SEW, a special pitch search for transitions, and switched-predictive analysis-by-synthesis gain VQ. These features improve the algorithm and its robustness. The test results indicate that the performance of the EWI coder slightly exceeds that of G.723.1 at 6.3 kbps and therefore EWI achieve very close to toll quality, at least under clean speech conditions.

The invention claimed is:

1. A method for using a computer processor to interpolatively code a digitized audio waveform input signal having a first bitrate into a coded audio waveform output signal having a second bitrate lower than said first bitrate, said method comprising the steps of:

extracting a slowly evolving waveform from the digitized audio waveform input signal;

estimating a dispersion phase of an excitation signal;

locking onto a most probable pitch period;

quantizing a sequence of gain trajectory correlation values;

using the computer processor to transform the extracted slowly evolving waveform, the estimated dispersion phase, the most probable pitch period and the quantized sequence of gain trajectory values into an interpolatively coded audio waveform output signal with said lower bitrate; and outputting said coded audio waveform output signal, wherein said method comprises using the computer processor to execute at least one step selected from the group consisting of:

(a) performing an analysis-by-synthesis vector quantization of the dispersion phase such that a linear shift phase residual is minimized;

(b) computing a weighted average of a group of adjacent pitch values in order to computer the most probable pitch period;

(c) performing spectral and temporal pitch searching in order to compute the most probable pitch period, such that the temporal pitch searching is performed at a different rate than the spectral pitch searching;

(d) incorporating temporal weighting in an analysis-by-synthesis vector-quantization of the gain trajectory correlation values;

(e) quantizing adjacent gain trajectory correlation values by analysis-by-synthesis vector-quantization without downsampling or interpolation;

(f) incorporating switched prediction filtering in an analysis-by-synthesis vector-quantization of the sequence of gain trajectory correlation values;

(g) temporal pitch searching with varying segment boundaries.

2. The method of claim 1 in which said method incorporates all of steps (a) through (g).

3. The method of claim 2 in which said digitized audio waveform input signal is representative of speech and said coded output signal has a subjective speech quality at 4 kbps better than that of G.723 coding at 6.3 kbps.

4. The method of claim 1, wherein distortion is reduced by obtaining an accumulated weighted distortion between a sequence of input waveforms and a sequence of quantized and interpolated waveforms.

5. The method of claim 1 wherein said at least one step is step (a) further comprising providing at least one codebook comprising magnitude and dispersion phase information for predetermined waveforms, approximately aligning a linear phase or output, then iteratively shifting the approximately aligned linear phase input or output, comparing the shifted input or output to a plurality of waveforms reconstructed from the magnitude and dispersion phase information contained in said at least one codebook, and selecting the reconstructed waveform that best matches one of the iteratively shifted inputs or outputs.

6. The method of claim 1 wherein said at least one step includes step (g) and said varying segment boundaries are used to compute a best boundary by iteratively shifting and changing the length of the segments.

7. The method of claim 1 wherein said at least one step is step (c), the spectral pitch search is conducted at a first rate and the temporal pitch searching is conducted at a second rate different from said first rate.

8. The method of claim 1 wherein said at least one step is step (d) and said temporal weighting emphasizes local high energy events in the input signal.

9. The method of claim 1, wherein said at least one step is step (e) or step (f) and both high correlation and low correlation synthesis filters are applied to a vector quantizer codebook and a selected one of the high and low correlation synthesis filters maximizes similarity between an input target gain vector and a reconstructed vector.

10. A method for using a computer to quantize audio waveforms comprising:

inputting digitized audio waveform signals to the computer, using the computer to generate a plurality of adjacent quantized and interpolated output waveforms having a lower bitrate than the input waveform signals;

using the computer to determine an accumulated distortion between the input waveform signals and each of said adjacent quantized and interpolated output waveforms; and generating a reconstructed waveform using said accumulated distortion.

11. The method of claim 10 including using accumulated spectrally weighted distortion.

12. A method for using a computer to interpolatively code digitized audio waveform signals comprising:

inputting the digitized audio waveform signals to the computer, extracting a slowly evolving waveform from said signals;

extracting a dispersion phase from said slowly evolving waveform;

performing an analysis-by-synthesis quantization of said dispersion phase; and using the quantized dispersion phase to transform the input waveform signals into an interpolatively coded output waveform signals having a lower bitrate than said input waveform signals.

13. The method of claim 12 further comprising:

providing at least one codebook containing magnitude and dispersion phase information for predetermined waveforms, approximately aligning a linear phase of the digitized audio waveform signals, then iteratively shifting the approximately aligned linear phase relative to a plurality of vectors reconstructed from the magnitude and dispersion phase information contained in said at least one codebook, and selecting one of the thus reconstructed vectors that best matches one of the iteratively shifted input vectors.

14. A method for using a computer processor to interpolatively code an audio waveform having certain attributes and components including a slowly evolving waveform and an associated dispersion phase, comprising:

inputting digitized audio waveform signals to the computer processor and using the computer to perform analysis-by-synthesis quantization of the associated dispersion phase, including providing at least one codebook containing magnitude and dispersion phase information for predetermined waveforms, crudely aligning a linear phase of the input vector, then iteratively shifting said crudely aligned linear phase input vector relative to a plurality of vectors reconstructed from the magnitude and dispersion phase information contained in said at least one codebook, and selecting the reconstructed vector that best matches the input vector, in which a distortion measure for a given data vector is determined by a perceptually weighted average of distortion measures for harmonics of the given data vector, wherein the perceptual weighted average combines a spectral-weighting and synthesis in which an average global distortion measure for a particular vector set M is an average of distortion measures for the vectors in M and global distortion is minimized by using a control formula to determine phases of harmonics; and using the thus selected best matching reconstructed vector to transform the input waveform signals into interpolatively coded output waveform signals having a lower bitrate than said input waveform signals.

15. The method of claim 14, wherein the centroid formula uses both input waveform coefficients and quantized slowly evolving waveform coefficients.

16. A method for using a computer to interpolatively code digitized audio waveform signals, comprising:

inputting the digitized audio waveform signals to the computer performing spectral pitch searching on said signals, performing temporal pitch searching on said signals;

determining a number of adjacent pitch values;

computing a most probable pitch value by computing a weighted average pitch value from the adjacent pitch values; and using the thus computed most probable pitch value to transform the input waveform signals into interpolatively coded output waveform signals having a lower bitrate than said input waveform signals.

17. The method of claim 16 in which in the step of performing temporal domain pitch searching comprises defining a boundary for a segment used for summations in a computed measure used for the pitch searching, and selecting the boundaries of the segment that optimizes the computed measure measure by iteratively shifting and expanding the segment.

18. The method of claim 16 in which the step of computing a number of adjacent pitch values includes using a respective function of normalized autocorrelations obtained for each pitch value as an associated probability weight to compute the weighted average pitch value.

19. A method for using a computer to interpolatively code digitized audio waveform signals comprising:

inputting the digitized audio waveform signals to the computer, performing spectral domain and temporal domain pitch searches to lock onto a most probable pitch period of each of the signals, determining a number of adjacent pitch values, then computing the most probable pitch value by computing a weighted average pitch value, and using the thus computed most probable pitch value to transform the digitized audio waveform signals into interpolatively coded output waveform signals having a lower bitrate than said digitized audio waveform signals, wherein the temporal domain pitch searching is based on harmonic matching using varying segment boundaries.

20. The method of claim 19 in which the spectral domain and temporal domain pitch searches are conduced respectively at 100 Hz and 500 Hz.

21. A method of using a computer to interpolatively code digitized audio waveform input signals comprising inputting the digitized audio waveform signals to a computer;

using a weighted average using normalized correlations for weights to compute a weighted average pitch value out of a set of pitch values of the waveform signals, wherein each of the pitch values is used to regenerate a respective reconstructed waveform; and using the thus computed weighted average pitch value to transform a digitized audio waveform signal into an interpolatively coded output waveform signal having a lower bitrate than said digitized audio waveform signals.

22. A method for using a computer to interpolatively code digitized audio waveform signals, comprising:

inputting the digitized audio waveform signals to the computer;

performing analysis-by-synthesis vector quantization of a gain sequence of each of the waveform input signals, and regenerating an output signal using said gain sequence; and using the resultant vector quantized gain sequence value to transform a digitized audio waveform signal into an interpolatively coded output waveform signal having lower bitrate than said digitized audio waveform signals.

23. The method of claim 22 including using temporal weighting which is changed as a function of time whereby to emphasize local high energy events in the input signals.

24. The method of claim 23, further comprising applying a synthesis filter or predictor, which introduces selected correlation to a vector quantizer codebook in the analysis-by-synthesis vector-quantization of the signal gain sequence to add selected self correlation to the codebook vectors.

25. The method of claim 24 in which selection between the high and low correlation synthesis filters or predictor is made to maximize similarity between signal and reconstructed vectors.

26. The method of claim 22, comprising using each value of gain index in the analysis-by-synthesis vector-quantization of the signal gain.

27. The method of claim 22 wherein each value of gain index is used to select from a plurality of shapes and associated predictors or filters, each of which is used to generate an output shape vector, and comparing the output shape vector to an input shape vector.

28. The method of claim 27 in which said plurality of shapes has a predetermined number of values in the range of 2 to 50.

29. The method of claim 27 in which said plurality of shapes has a predetermined number of values in the range of 5 to 20.

30. The method of claim 22 including using a switch predictive synthesis filter or predictor.

31. A method for using a computer to interpolatively code audio waveforms signals, comprising:

inputting a digitized waveform signal to the computer;

decomposing said signal into a slowly evolving waveform, performing a vector-quantization of a dispersion phase by the slowly evolving waveform from which a linear shift attribute was reduced or removed and transforming the digitized audio waveform signals into interpolatively coded output waveform signals having a lower bitrate than said digitized audio waveform signals, wherein a plurality of bits of the coded output waveform signals are allocated to the vector-quantized dispersion phase with the reduced linear shift attribute.

32. The method of claim 31 in which at least one bit is allocated to the dispersion phase.

33. A method for using a computer to interpolatively code audio waveform signals comprising:

inputting digitized audio waveform signals to a computer;

using at least one processor of the computer to:

determine input vectors representing the waveform signals;

determine interpolated vectors for modeling the input vectors;

compute an accumulated weighted distortion between the input vectors and the interpolated vectors as a sum of a modeling distortion and a quantization distortion; and determine an optimal vector which minimizes the modeling distortion; and using the thus computed accumulated weighted distortion to transform the digitized audio waveform signals into interpolatively coded output signals having a lower bitrate than said digitized audio waveform signals.

34. The method of claim 33 further comprising:

using at least one processor of the computer to determine a respective quantized vector from the optimal vector.

* * * * *